US005785584A

United States Patent [19]

Marmillion et al.

[11] Patent Number: 5,785,584

[45] Date of Patent: Jul. 28, 1998

[54] PLANARIZING APPARATUS WITH DEFLECTABLE POLISHING PAD

[75] Inventors: Patricia E. Marmillion, Colchester; Anthony M. Palagonia, Underhill, both of Vt.

[73] Assignee: International Business Machines Corporation, Armonk, N.Y.

[21] Appl. No.: 706,155

[22] Filed: Aug. 30, 1996

[51] Int. Cl.[6] ..... B24B 5/00

[52] U.S. Cl. ..... 451/283; 451/287; 451/495; 451/528

[58] Field of Search ..... 451/41, 283, 287, 451/288, 289, 290, 495, 527, 528, 530

[56] References Cited

U.S. PATENT DOCUMENTS

| | | |
|---|---|---|
| 5,177,908 | 1/1993 | Tuttle . |
| 5,212,910 | 5/1993 | Breivogel et al. . |
| 5,234,867 | 8/1993 | Schultz . |
| 5,257,478 | 11/1993 | Hyde et al. . |
| 5,287,663 | 2/1994 | Pierce et al. . |
| 5,377,451 | 1/1995 | Leoni et al. . |
| 5,421,769 | 6/1995 | Schultz et al. . |
| 5,423,716 | 6/1995 | Strasbaugh . |
| 5,435,772 | 7/1995 | Yu . |
| 5,486,129 | 1/1996 | Sandhu et al. . |
| 5,558,563 | 9/1996 | Cote et al. ..... 451/41 |

FOREIGN PATENT DOCUMENTS 3-259520 11/1991 Japan .

*Primary Examiner*—Timothy V. Eley
*Attorney, Agent, or Firm*—Whitham, Curtis & Whitham; Howard J. Walter

[57] ABSTRACT

A planarizing system which significantly reduces the problems associated with non-uniform removal of surface material across the face of a semiconductor wafer or other comparable workpiece. The invention involves a planarizing apparatus that takes the leading edge of a wafer out of contact with the polishing pad while concomitantly enhancing slurry penetration and distribution at the polishing pad-wafer interface. This result is accomplished by combining: means for deflecting upward a portion of a flexible polishing pad as it passes in rotation beneath a wafer to form a raised polishing pad area, and means for positioning the wafer such that the wafer's leading edge overhangs the front edge of the raised polishing pad area during the planarization procedure. The invention also encompasses a method of using the planarizing apparatus to uniformly remove surface material across the face of a wafer.

18 Claims, 2 Drawing Sheets

PLANARIZING APPARATUS WITH DEFLECTABLE POLISHING PAD

BACKGROUND OF THE INVENTION

1. Field of the Invention

The invention relates to a planarizing apparatus and a method of its use to increase uniformity in removal rates across a workpiece surface, such as a semiconductor wafer surface.

2. Background of the Invention

In the manufacture of integrated circuit semiconductor devices, a series of wafer masking and processing steps are used to fabricate each integrated circuit over the polished surface of a wafer. These masking and processing steps often result in the formation of topographical irregularities, such as "steps," on the wafer surface. Serious problems can result from these topographical irregularities if left present during subsequent processing of the integrated circuits on the wafer surface. For instance, step formations may cause focusing problems during optical lithography and the lack of surface planarization may make it difficult to form subsequent layers of metal interconnect. Consequently, planarizing an undulated surface layer, e.g., a dielectric layer residing on the surface of a wafer after metallization or other stages, has been conventionally practiced in semiconductor device fabrication to avoid such problems.

One popular conventional technique for planarizing is chemical-mechanical planarizing ("CMP"). A CMP process generally involves holding and rotating a thin wafer of semiconductor material against a polishing surface under controlled pressure and temperature while the polishing surface-wafer interface is continuously wetted with an abrasive slurry. CMP equipment used to perform planarizing of a semiconductor wafer generally includes a polishing pad supported on a rotatable platen, and a rotatable wafer holder which can apply a controlled downward pressure to the wafer to press the wafer against the top surface of the polishing pad. During planarizing and polishing, the polishing pad and wafer are typically rotated in the same direction. While the wafer and polishing pad rotate, the wafer is also horizontally translated back and forth by the wafer holder across the surface of the polishing pad. This oscillating motion covers a linear distance referred to as an oscillating range. During operation, a slurry of colloidal silica or another suitable abrasive is introduced between the outer surface of the wafer and the polishing pad. An etchant can be mixed in with the slurry to chemically assist removal of the surface material from the wafer. The reaction between the slurry and the wafer surface layer, such as a dielectric layer, under the polishing motion results in chemical-mechanical removal of the wafer surface material. Representative illustrations of the basic conventional scheme of the polishing pad, wafer holder and slurry features in a CMP apparatus are taught, for example, in U.S. Pat. Nos. 5,177,908 and 5,234,867. Ideally, the wafer surface topography should be uniformly planarized by CMP processing.

However, a persistent problem encountered in CMP processing is the non-uniform removal of the semiconductor surface. In particular, removal rates tend to be higher at the wafer edge than at the central portion of the wafer because the wafer edge is rotating at a higher speed than the wafer center. This phenomenon is referred to as the "leading edge effect." Other factors contributing to the problem of non-uniform removal include non-uniform wafer pressure, and uneven slurry distribution.

The prior art has proposed to redress the problem of nonuniform planarizing and polishing by modifying the polishing pad itself. For instance, patterns or special configurations have been formed in the shape of the polishing pad, such as taught, for example, in U.S. Pat. Nos. 5,177,908, 5,234,867 and 5,435,772.

U.S. Pat. No. 5,435,772, in particular, describes a variegated polishing pad for polishing semiconductor wafer in which the polishing pad itself is configured with a varied height or a varied compressibility for the stated purposes of improving polishing uniformity. In a dual height polishing pad arrangement taught by U.S. Pat. No. 5,435,772, the surface of the polishing pad is contoured to present an inner circular section that is thicker and thus projects beyond a surrounding concentric region of the pad. The wafer's leading edge can overhang the lower portion of the pad during polishing. In a separate embodiment the pad has an even surface except adjoining regions of different compressibility are provided such that the wafer's leading edge overhangs the lower portion of the pad. The directions of rotation of both the wafer and polishing pad extend generally tangentially to both the profiles of the leading edge of the wafer and the overhung outer edge of the upraised pad portion in U.S. Pat. No. 5,435,772.

However, the pad and wafer geometry of U.S. Pat. No. 5,435,772 can be expected to result in a tendency for the abrasive slurry to be pushed out of the vicinity of the pad-wafer interface and out from beneath the overhang of the wafer's leading edge. Once so pushed out, the slurry will be slung away from the polishing pad-wafer interface where needed. The resulting disturbances or even disruptions in the supply of abrasive slurry at the polishing pad-wafer interface could adversely impact the outcome of the planarization procedure.

SUMMARY OF THE INVENTION

It is an object of the present invention to provide a planarizing system which significantly reduces the problems associated with non-uniform removal of surface material across the face of a semiconductor wafer or other comparable workpiece.

These and other objects, advantages, and benefits are achieved in the present invention involving a planarizing apparatus that takes the leading edge of a wafer out of contact with the polishing pad while concomitantly enhancing slurry penetration and distribution at the polishing pad-wafer interface.

This result is accomplished in the present invention by combining:

- means for deflecting upward a portion of a flexible polishing pad as it passes in rotation beneath a wafer to form a raised polishing pad area, and
- means for positioning the wafer such that the wafer's leading edge overhangs the front edge of the raised polishing pad area during the planarization procedure.

In one preferred embodiment, the rotating polishing pad is caused to flex upward as it passes over a discrete, noncontinuous "bump" formed in the surface of an underlying stationary platen. This deflection in any given portion of the pad is a transient condition as the raised portion of the pad will fall back to its original configuration once it clears the underlying stationary bump; however, the rotation of the pad continuously feeds pad surface area over the bump to effectively replenish pad portions at the front edge of the bump as quickly as pad area moves off the back edge of the bump. This phenomenon occurs because the polishing pad is set in continuous rotation about a central axis of rotation during the planarization procedure while the bump is fixed in location. Thus, portions of the pad will be continuously progressed up, over and back down, and then be returned again after a single rotation to, the underlying stationary bump. Consequently, a discrete raised portion is created in the polishing pad surface at a fixed location.

Also, the wafer is situated, such as via a lateral wafer displacement means, such that the wafer's leading edge overhangs the raised polishing pad area and consequently not all surface regions of the wafer contact and directly overlay the raised polishing pad area. The term "leading edge", as used in connection with the wafer or the raised polishing pad area, means the edge that is initially contacted with the loose abrasive slurry being fed to the polishing pad-wafer interface. This inventive planarizing apparatus and its manner of use permits a polishing slurry to penetrate the pad-wafer interface and evenly distribute itself over the major face of the wafer and the contacting portion of the uplifted polishing pad.

The present invention effectively counteracts the leading edge effect problem associated with prior CMP processes and equipment. The uniform rate of planarizing achieved from the outer edge of a wafer to the interior thereof enables uniform film thicknesses to be formed on surfaces of the wafer in subsequent processing.

These and other objects and features of the invention will become more fully apparent from the several drawings and description of the preferred embodiments.

DETAILED DESCRIPTION OF THE PREFERRED EMBODIMENTS OF THE INVENTION

Figure 1:
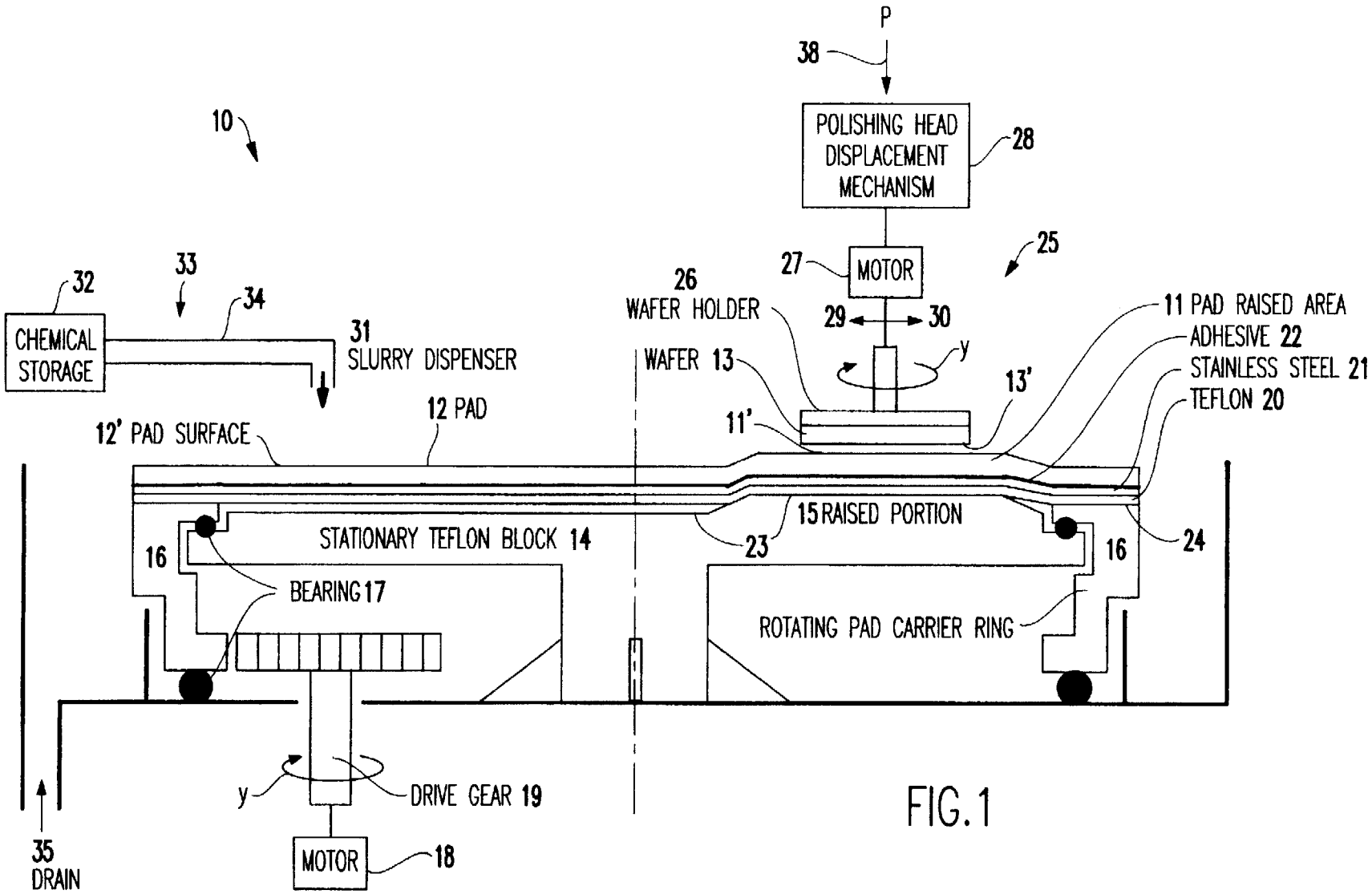
FIG. 1 is a cross-sectional view of the planarizing apparatus of the present invention taken along direction A—A shown in FIG. 2A.
Figures 2A, 2B:
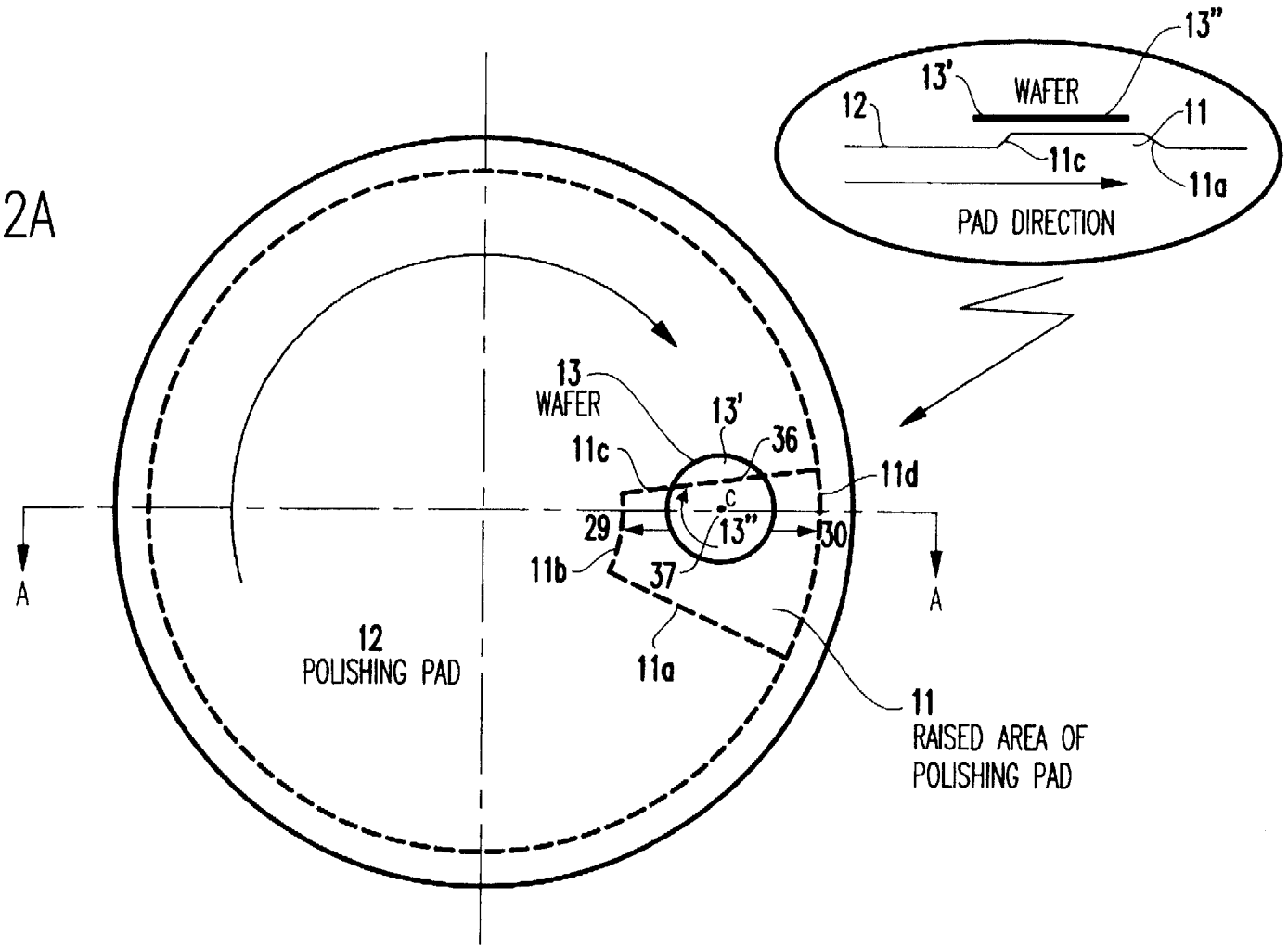
FIG. 2A is a top view of the planarizing apparatus shown in FIG. 1.
FIG. 2B is an enlarged, partial side view showing the raised polishing pad area and wafer element illustrated in FIG. 2A.

Referring now to the drawings, and more particularly to FIG. 1, there is shown a chemical-mechanical planarizing apparatus 10 of the present invention. Essential features of the invention involve the provision of the raised portion 11 of the polishing pad 12 and control of where the wafer 13 contacts this raised portion 11 to form a wafer overhang 13'. The wafer overhang 13' is best seen in FIGS. 2A–2B. FIG. 1 shows polishing pad 12 in a non-contacting mode with wafer 13 merely to facilitate the depiction of elements.

The polishing pad 12 is made to rotate and rise up under the wafer 13 and then fall back after clearing raised pad portion 11. The raised pad portion 11 is formed by an uplifting means capable of raising a portion of pad 12. As illustrated in FIG. 1, a stationary TEFLON™ (polytetrafluoroethylene) block 14 is fabricated, e.g., molded, with a discrete, noncontinuous raised portion 15, as such a pad uplifting means, which is formed in the surface of the block 14. The raised portion 15 is integral with block 14. As best indicated in FIG. 2A, raised block area 15 is flat surfaced to present a profile shape that will be replicated in the raised pad area 11. Although a truncated wedge or trapezoidal shape is illustrated in the figures herein, any raised block portion 15 and corresponding raised pad area 11 geometries can be practiced that meet the proviso of permitting the desired amount of wafer overhang to be established and maintained, and which accommodate the wafer oscillating range.

Although exemplified above as a static raised portion 15 formed integral with block 14, the uplifting means does not necessarily have to be a static structure. For example, the pad uplifting means used to form the raised pad area 11 may also be a roller, roller pin, or other similar dynamic structure located in a fixed position beneath pad 12, yet capable of exerting pressure upon the lower surface of pad 12 (such as via its underlying layers described below). For instance, the uplifting means could be a roller pin structure where the roll is freely rotatable with its roll surface oriented tangentially to the pad underside while the support pin is attached, such as to block 14, to fix the position of the roll beneath pad 12.

Returning to FIG. 1, block 14 is formed of a material having a low coefficient of friction. Block 14 and its raised portion 15 are stationary. Block 14 is circular in profile from a top perspective and it thus has a circular periphery. A rotatable pad carrier ring 16 is positioned around the entire periphery of the block 14 and bearings 17 permit independent movement of the ring 16 relative to stationary block 14. Motor 18, or other driver means, in conjunction with drive gear 19 rotates pad carrier ring 16 in a selected rotational direction y.

In order to fasten a polishing pad to the upper surface of pad carrier ring 16, a sheet 20 of TEFLON™ material, or other material having a low coefficient of friction, is conformably draped over the top surface 23 of the stationary block 14. A thin stainless steel layer 21 is arranged on top of the TEFLON™ sheet 20. The sheet 20 and stainless steel layer 21 are directly fastened across the top plane 24 of the stationary ring 16 via any convenient mechanical attachment means, such as with screws, bolts, rivets, and the like. The lower surface of the sheet 20 is only attached to pad carrier ring 16, and not to block 14 so that the sheet 20 and layers attached thereon can freely slide over the top surface 23 of the stationary block 14 when pad 12 is set in rotation. A polishing pad 12 with an adhesive backing 22 is attached on top of the stainless steel sheet 21 via the adhesive 22. The adhesive backing 22 can be a pressure sensitive adhesive (PSA). The polishing pad 12 may be made of a porous and durable resilient material, such as polyurethane material, having a relatively uniform thickness. The thickness of the pad 12 is not limited except that it must be thin enough that the step or raised area can be imparted into it. The polyurethane pad may have a thickness of about 50 mils (about 0.06 mm) and an average pore sizing of about 3 to about 400 microns. During planarization, the polishing pad 12 rotates and is urged into into contact with the wafer 13 via downward pressure P (as indicated by arrow 38) exerted on wafer holder 26 such that the surface 13' of semiconductor wafer 13 contacts pad 12 in a manner which facilitates planarizing or polishing of surface 13'.

The sheet layer 20, stainless steel layer 21 and pad 12 are all circular and have the same diameter. The diameter of these layers 20, 21 and 12 must be sufficient to span the surface 23 of block 14 including the raised block area 15 and be sufficient to allow their attachment to the top plane 24 of pad carrier ring 16. The thickness of the TEFLON™ sheet layer 20 and stainless steel layer 21 is selected so as to be deflectable by the raised portion 15 of the stationary TEFLON™ block 14. The Teflon™ sheet 20 preferably is selected as thin as possible while still possessing adequate physical durability so as not to wear out too rapidly. Sheet 20 may have a thickness ranging from about 4/100 to about 25/100 inches (about 1.0 to about 6.4 mm), preferably 6/100 inches (about 1.5 mm). The stainless steel layer 21 also preferably is selected to be as thin as possible but which will not crack. Sheet 21 may have a thickness ranging from about 1/100 to about 6/100 inches (about 0.25 mm to 1.5 mm about), preferably about 2/100 inches (about 0.5 mm).

The planarization apparatus 10 also includes polishing head assembly 25 which includes polishing head 26 which holds the wafer 13 by any conventional means known in the art, motor 27, and polishing head displacement mechanism 28. Polishing head 26 holds surface 13' of the semiconductor wafer 13 in juxtaposition relative to raised area 11 of polishing pad 12. Motor 27, or other drive means, rotates polishing head 25 and wafer 13 in a selected rotational direction y which is the same rotational direction that pad carrier ring 16 is rotated by motor 18.

Polishing head displacement mechanism 28 performs at least two basic functions. First, it moves wafer 13 laterally back and forth across the raised area 11 of pad 12 as indicated by arrows 29 and 30 at an oscillating velocity during planarizing while pad 12 and wafer 13 are rotating. The oscillating range preferably is appropriately controlled to prevent the wafer 13 from overhanging either of side edges 11*b* or 11*d* of raised pad area 11, as best seen in FIG. 2A. Another function of polishing head displacement means 28 is moving the wafer 13 laterally to a position over pad 12 such that wafer 13 overhangs the front edge 11*c* of the pad's raised area 11 as overhang 13', as best seen in FIG. 2A.

The wafer or other type of workpiece 13 preferably has a circular periphery, as best seen in FIG. 2A, for sake of symmetry and to facilitate centering of the object over the raised pad area 11. Since the wafer 13 is supported in a wafer holder 26, a large wafer overhang is possible although only a few millimeters (i.e., 1–5 mm) of overhang is needed to realize the effect of making uniform the rate of wafer material removal at the outer wafer portion 36 relative to the inner wafer portion 37 located radially nearer the center point "c" of the wafer. The desired amount of wafer overhang 13', such as depicted in FIGS. 2*a* and 2B, should be established by displacement means 28 before the planarization procedure is initiated. The amount of overhang 13' provided is not particularly limited other than being an amount sufficient to equalize the removal rate at the outer radial portions the wafer 13 with that observed for the inner, central area of the wafer 13.

The transverse distance between the front edge 11*c* and the back edge 11*a* of raised pad area 11 preferably is large enough to provide a raised pad area that accommodates and contacts the entirety of the non-overhanging portion 13" of the wafer 13. However, in processes that require it, the trailing edge of the wafer also may be positioned to overhang rear edge 11*a* of raised area 11, such that a front and back overhang is formed in the wafer 13 relative to raised pad area 11. The center point of the wafer 13 should always be located over raised pad area 11.

The total difference in height between the normal (non-deflected) portion 12' and raised portion 11 of the pad 12 carrier need only be such as to provide about 1–2 millimeter vertical difference between the non-deflected pad surface 12' and the upper surface 11' of the pad area as compressed and located under the wafer 13 in raised area 11. The leading edge 11*c* of the raised area 11 may be substantially perpendicular to the non-deflected pad surface 12' or have a slope rising over about 10–50 millimeters. Preferably, the slope angle made between the non-deflected pad surface 12' and the leading edge 11*c* of the raised area 11 may be about 15° to about 75°, more preferably about 30°.

The slurry dispenser 31 shown in FIG. 1 will be located directly upstream of the leading edge of the wafer overhanging front edge 11*c* of the upraised pad portion 11. Chemical supply system 33 includes a chemical storage 32 and a conduit 34 for transferring the slurry from chemical storage 32 to dispenser 34. Alkali or acidic chemical etchants can be included, if desired, in the abrasive solution. The abrasive slurry preferably is formed of a solution including colloidal silica or alumina. During the chemical mechanical planarizing, the loose abrasive slurry should level the wafer surface topography, but the loose abrasive slurry should not cause any undercuts. If the slurry dispenser 31 is a single spout structure, it can be located approximately 20–30 cm in front of the leading edge of the wafer and centrifugal forces will spread out the slurry into a uniform spray by the time it reaches the wafer's leading edge. Alternately, the slurry dispenser 31 can be a multi-apertured, flat or arc-shaped dispensing head which is located in closer proximity to the wafer's leading edge. A drain 35 is provided for collecting used slurry. The polishing slurry can optionally be collected and recycled for reuse during planarizing operations.

The present invention provides superior fluid penetration and distribution of the slurry wetting the surface portion of the wafer contacting the upraised polishing pad area. The inventive planarizing tool arrangement results in the loose abrasive slurry being advanced and moved in a direction perpendicular to the front edge of upraised pad portion located beneath the overhang of the wafer's leading edge, which encourages penetration of the slurry into the interface of the polishing pad and juxtaposed face of the wafer and also promotes uniform distribution of slurry over these surfaces when wetted with the slurry. Consequently, a superior planarizing rate is achieved. Furthermore, a build-up of slurry is created and maintained at the leading edge of the wafer in the recess formed between the wafer overhang and front edge of the upraised pad portion (as a backstop of sorts), to ensure a uniform and constant supply of slurry into the pad-wafer interface during the planarizing operation. Consequently, a more uniform planarizing rate is achieved across the wafer surface due to these superior fluid dynamics created and exploited in the present invention.

The present invention should not be construed as limited by the embodiments or materials illustrated herein. For instance, while the invention has been described in terms of a preferred embodiment involving semiconductor wafers as the polished or planarized substrate, it will be recognized that the invention also has applicability to polishing or planarization of other types of substrates and workpieces having macroscopically flat surfaces, such as optical materials (e.g., glass, polycarbonate). Semiconductor wafer workpieces that can be planarized by the present invention include, for example, silicon, germanium, gallium arsenide and other Group III–V semiconductors.

Also, while a single uplifting means, such as an upraised block area, has been exemplified, it will be understood that more than one uplifting means, such as plurality of separate stationary bumps can be provided in the stationary block, space permitting, to form a plurality of separate upraised areas in the overlying polishing pad to allow more than one wafer to be planarized simultaneously on the apparatus. The uplifting means, such as wedge-shaped bumps, must be spaced apart sufficient to accommodate the physical dimensions of the wafers themselves including those of their corresponding upraised pad portions, the oscillating range of each wafer, and to allow room for an individual slurry dispenser to be installed and operated for each wafer.

Furthermore, the planarizing tool of the present invention generally can be used in any application of chemical-mechanical planarization, mirror-polishing, and/or lapping operations performed on semiconductor substrates.

While the invention has been illustrated in terms of the embodiments described above, those skilled in the art will recognize that the invention can be practiced with modification within the spirit and scope of the appended claims.

What is claimed is:

1. A planarizing apparatus for planarizing a workpiece having an inner radial portion and an outer radial portion, comprising:

a polishing pad having an upper surface;

drive means for rotating said polishing pad in a rotational direction;

uplifting means for raising a portion of said upper surface of said polishing pad to contact an inner radial portion of the workpiece, said raised pad portion having a leading edge facing said rotational direction, wherein said uplifting means comprises a circular stationary block including a block top surface and a circular periphery, said block top surface including an integral upward raised projection capable of deflecting upward said portion of said upper surface of said polishing pad; and adjustment means to position an outer radial portion of said workpiece to overhang said leading edge of said raised pad portion.

2. The planarizing apparatus of claim 1, wherein said integral raised projection has a trapezoidal shape.

3. The planarizing apparatus of claim 1, wherein said drive means for rotating said polishing pad comprises a rotatable pad carrier ring having a top plane arranged concentrically around the circular periphery of said stationary block, wherein said polishing pad is attached to said top plane of said pad carrier ring and said polishing pad can independently move in rotation relative to said stationary block.

4. The planarizing apparatus of claim 3, further comprising a deflectable polytetrafluoroethylene layer, a deflectable stainless steel layer, and an adhesive layer, in that sequence on said pad carrier ring, providing means for attaching said polishing pad to said top plane of said pad carrier ring and promoting independent rotary movement of said polishing pad relative to said stationary block.

5. The planarizing apparatus of claim 1, wherein said stationary block is formed of polytetrafluoroethylene.

6. The planarizing apparatus of claim 1, wherein said polishing pad comprises a polyurethane material having flat major surfaces.

7. The planarizing apparatus of claim 1, wherein said adjustment means comprises a wafer holder and a lateral displacement mechanism, said lateral displacement mechanism capable of laterally moving said wafer across said upper pad surface.

8. The planarizing apparatus of claim 1, further comprising a slurry dispenser capable of supplying abrasive slurry to said leading edge of said raised pad portion.

9. The planarizing apparatus of claim 8, wherein said slurry dispenser is located upstream of said leading edge of said raised pad portion and said slurry dispenser being capable of said supplying of said loose abrasive slurry in a direction perpendicular to said leading edge of the raised pad portion.

10. The planarizing apparatus of claim 1, wherein said raised pad portion further comprises opposing side edges extending along said rotational direction of said polishing pad, wherein said adjustment means further produces a position in said outer radial portion of said workpiece being devoid of overhang at said side edges of said raised pad portion.

11. A planarizing apparatus for planarizing a workpiece having an inner portion and an outer portion, comprising:

a polishing pad having an upper surface;

drive means for rotating said polishing pad;

uplifting means for raising a portion of said upper surface of said polishing pad, said raised pad portion having a leading edge, to contact an inner portion of a workpiece, wherein said uplifting means comprises a circular stationary block including a block top surface and a circular periphery, said block top surface including an integral upward raised projection capable of deflecting upward said portion of said upper surface of said polishing pad; and adjustment means for adjusting a position of an outer portion of said workpiece relative to said leading edge.

12. The planarizing apparatus of claim 11, wherein said integral raised projection has a trapezoidal shape.

13. The planarizing apparatus of claim 11, wherein said drive means for rotating said polishing pad comprises a rotatable pad carrier ring having a top plane arranged concentrically around the circular periphery of said stationary block, wherein said polishing pad is attached to said top plane of said pad carrier ring and said polishing pad can independently move in rotation relative to said stationary block.

14. The planarizing apparatus of claim 13, further comprising a deflectable polytetrafluoroethylene layer, a deflectable stainless steel layer, and an adhesive layer, in that sequence on said pad carrier ring, providing means for attaching said polishing pad to said top plane of said pad carrier ring and promoting independent rotary movement of said polishing pad relative to said stationary block.

15. The planarizing apparatus of claim 11, wherein said stationary block is formed of polytetrafluoroethylene.

16. The planarizing apparatus of claim 11, wherein said polishing pad comprises a polyurethane material having flat major surfaces.

17. The planarizing apparatus of claim 11, wherein said adjustment means comprises a wafer holder and a lateral displacement mechanism, said lateral displacement mechanism capable of laterally moving said wafer across said upper pad surface.

18. The planarizing apparatus of claim 11, further comprising a slurry dispenser capable of supplying abrasive slurry to said leading edge of said raised pad portion.

* * * * *